United States Patent [19]

Mullins

[11] Patent Number: 4,653,167

[45] Date of Patent: Mar. 31, 1987

[54] ROTARY TOOL ASSEMBLY AND METHOD FOR REPAIRING DENTS IN SHEET METAL

[76] Inventor: Eugene M. Mullins, 1535 ½ S. Ida, Wichita, Kans. 67211

[21] Appl. No.: 720,817

[22] Filed: Apr. 8, 1985

Related U.S. Application Data

[63] Continuation-in-part of Ser. No. 538,528, Oct. 10, 1983, abandoned.

[51] Int. Cl.[4] ..... B21D 1/12

[52] U.S. Cl. ..... 29/402.18; 72/71; 72/705; 264/36

[58] Field of Search ..... 72/379, 114, 456, 112, 72/71, 325, 324; 10/140; 29/402.01, 402.04, 402.05, 402.06, 402.07, 402.09, 402.16, 402.18, 402.19; 264/36; 156/94

[56] References Cited

U.S. PATENT DOCUMENTS

| | | | |
|---|---|---|---|
| 2,479,730 | 8/1949 | Dewar | 10/140 |
| 3,066,719 | 12/1962 | Selnick | 29/402.19 |
| 3,187,538 | 6/1965 | Painter | 72/114 |
| 3,242,239 | 3/1966 | Schafer | 264/36 |
| 3,429,171 | 2/1969 | Feher | 72/325 |
| 3,635,072 | 1/1972 | Steinmann, Jr. | 72/705 |
| 4,037,448 | 7/1977 | Di Maio | 72/705 |
| 4,050,271 | 9/1977 | Jones | 72/705 |
| 4,072,042 | 2/1978 | Servin et al. | 72/705 |
| 4,121,444 | 10/1978 | Duran | 72/114 |

*Primary Examiner*—Lowell A. Larson
*Attorney, Agent, or Firm*—Phillip A. Rein

[57] ABSTRACT

A rotary tool assembly and method for repairing dents in sheet metal features a self-drilling sheet metal screw held within a rotary chuck. A back plate is coupled for relative rotation and limited axial movement about an outer anchor portion of the chuck. A threaded ram secures the self-drilling sheet metal screw within the chuck. A coupling shaft portion of the ram is engaged by the chuck of a power drill. In operation, the self-drilling sheet metal screw of the rotary tool assembly is pressed against a dented portion of a sheet metal panel which is to be straightened. Rotation of the chuck causes an outer drill bit section of the self-drilling sheet metal screw to penetrate the sheet metal to form a drilled hole, back pressure is maintained, and the sheet metal is pulled outwardly. Drilling is continued until the sheet metal panel is pulled against the back plate which may be of various sizes and shapes. As the sheet metal is pulled flat against the back plate and the chuck, the metal surrounding the self-drilling sheet metal screw becomes stripped, thereby releasing the rotary tool assembly. This process is repeated until the dented area of the sheet metal panel approximates its original form but having a circular indentation about each of the drilled holes which are then filled, sanded, and painted.

8 Claims, 11 Drawing Figures

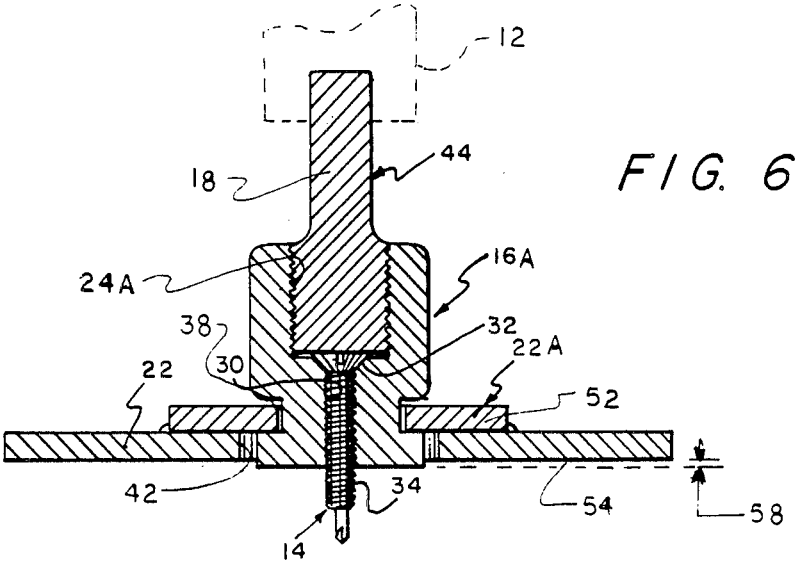
FIG. 6
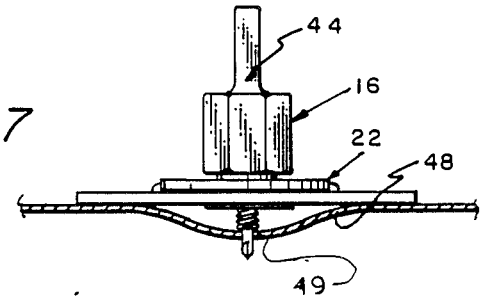
FIG. 7
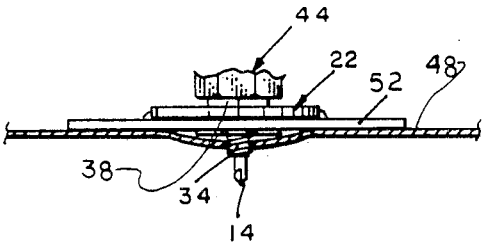
FIG. 8
FIG. 9
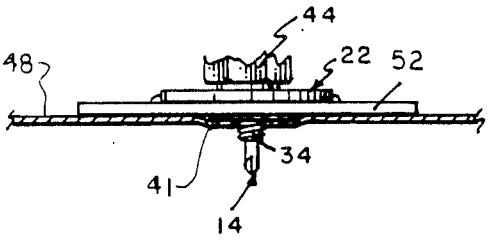
FIG. 10
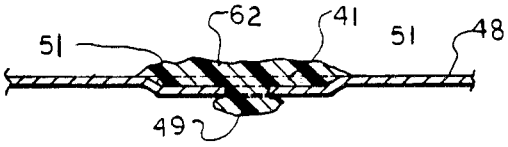
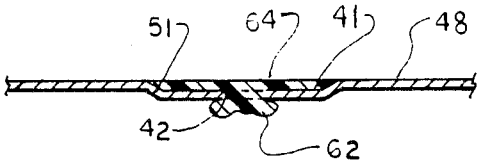
FIG. 11

ROTARY TOOL ASSEMBLY AND METHOD FOR REPAIRING DENTS IN SHEET METAL

PARENT APPLICATION

This application is a "continuation-in-part" application having subject matter disclosed and claimed that was previously set forth in parent application entitled "TOOL FOR REPAIRING DENTS IN SHEET METAL": Ser. No. 538,528; Filing Date Oct. 10, 1983, now abandoned; and Inventor Eugene M. Mullens. The parent application will be allowed to go abandoned.

BACKGROUND OF THE INVENTION

1. Field of the Invention

This invention relates generally to power tool accessories and, in particular, to a rotary tool for repairing dents in sheet metal.

2. Description of the Prior Art

In automobile body work, dents in sheet metal body panels are repaired manually by using a heavy knocker bar. This method requires considerable personal skill and involves personal judgement as to the placement and force applied to the knocker bar. Some dents, for example, a dent located in a door panel, can be reached only after the door panel has been disassembled. In other panel areas, the dented area can be reached by the knocker bar, but there is not sufficient room to manipulate the knocker bar properly to restore the original form of the sheet metal panel. The prior art methods require additional steps such as drilling holes, etc., which are not required by applicant's invention.

SUMMARY OF THE INVENTION

The problem of access to the rear side of a dented sheet metal panel is avoided in the present invention by a powered rotary drill tool which features a self-drilling sheet metal screw held within a rotary chuck. A back plate is coupled for rotation about an anchor portion of the chuck. A threaded ram secures the self-drilling sheet metal screw within the chuck. A coupling shaft portion of the ram is engaged by the chuck of a power drill.

In operation, the self-drilling sheet metal screw of the tool assembly includes an outer drill section which is pressed against a dented portion of a sheet metal panel which is to be straightened. When the power drill is energized, rotation of the tool body causes the outer drill bit section of the self-drilling sheet metal screw to penetrate the sheet metal. After the outer drill bit section has entered the sheet metal, back pressure is maintained and the sheet metal is pulled outwardly as the threads of the self-drilling sheet metal screw rotate. Due to offset relationships between the rotary back plate and the outer end of the anchor portion of the chuck, a circular indentation is left about the drilled hole which is important in the repair process. Drilling is continued until the dented sheet metal is pulled against the rotary back plate of the rotary tool assembly. As the sheet metal is pulled flat against the back plate, the metal surrounding the self-drilling sheet metal screw becomes stripped, thereby releasing the rotary tool assembly. This process or method is repeated until the dented sheet metal has been pulled flat. The drill openings, circular indentations, and restoration area are then filled with repair material as necessary, and the dented region is then finished by sanding and painting and leaves a rivet repair structure.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawings.

BRIEF DESCRIPTION OF THE DRAWINGS

FIG. 6 is a sectional view similar to FIG. 4 showing a second embodiment of this invention;

FIGS. 7, 8 and 9 are schematic diagrams illustrating the repair method of operation with the rotary tool assembly of this invention; and FIGS. 10 and 11 illustrate the repair method of this invention on finishing the repaired area.

DETAILED DESCRIPTION OF THE PREFERRED EMBODIMENT

Figure 1:
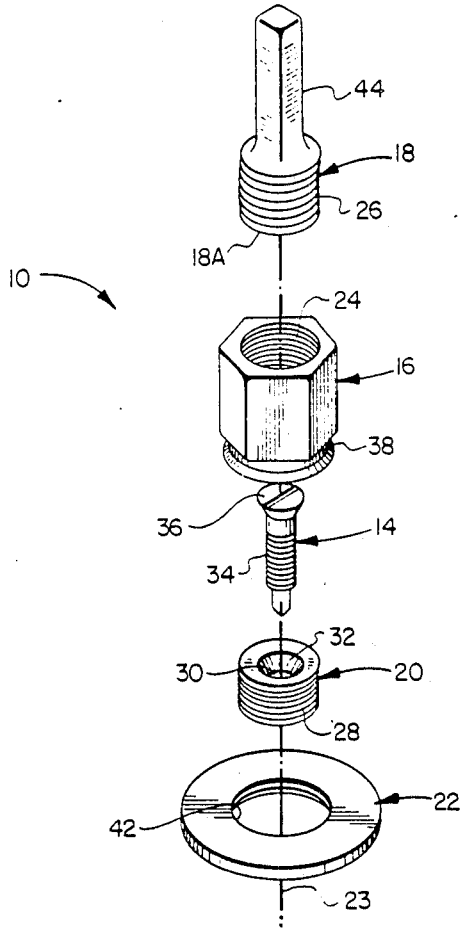
FIG. 1 is an upper exploded perspective view of the sheet metal repair rotary tool assembly of this invention.
Figure 2:
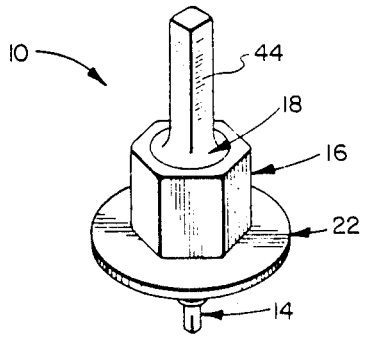
FIG. 2 is a top perspective view of the assembled sheet metal repair rotary tool assembly.
Figure 3:
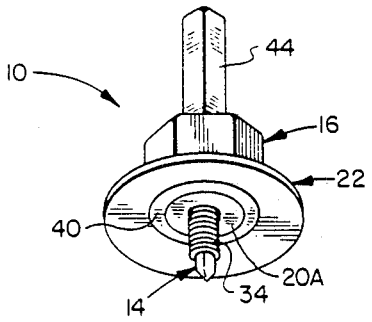
FIG. 3 is a bottom perspective view of the assembled repair rotary tool assembly.

In the description which follows, like parts are marked throughout the specification and drawings with the same reference numerals, respectively. The drawings are not necessarily to scale, and in some instances, proportions have been exaggerated in order to more clearly depict certain features of the invention.

Figure 4:
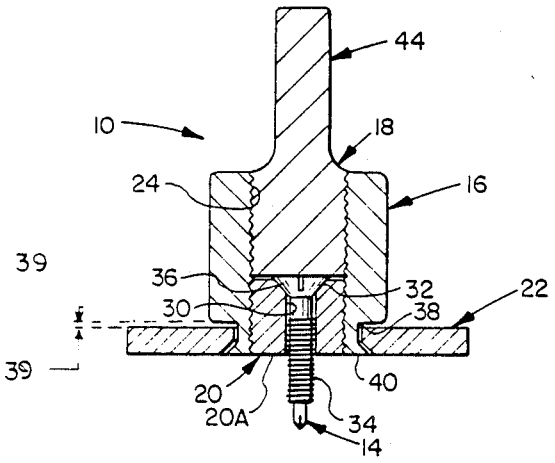
FIG. 4 is a sectional view taken through the longitudinal axis of the assembled repair rotary tool assembly.
Figure 5:
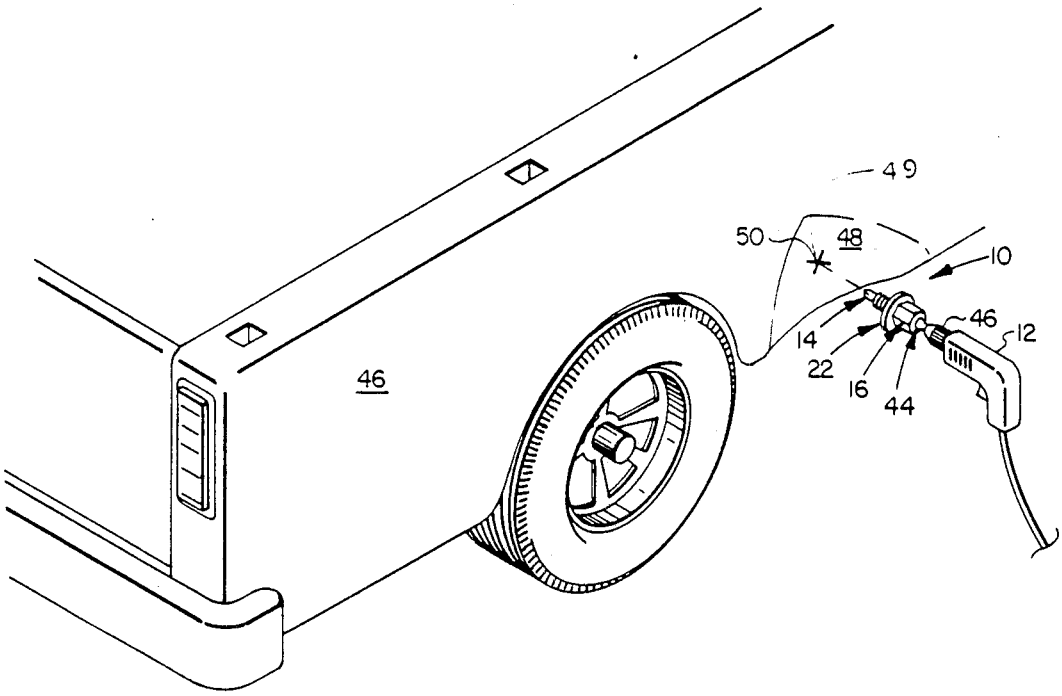
FIG. 5 is a partial perspective view which illustrates operation of the sheet metal repair rotary tool assembly as used in automobile body work.

Referring now to FIGS. 1, 4 and 5, a sheet metal repair rotary tool assembly 10 is adapted for use in combination with a power drill 12. The principal components of the sheet metal repair rotary tool assembly 10 are a self-drilling sheet metal screw or threaded drill bit 14, a chuck 16, a ram 18, a sleeve 20, and an annular back plate 22, all of which are disposed in coaxial alignment with the axis of rotation 23. The chuck 16 has a threaded bore 24 in which the ram 18 and sleeve 20 are received. The ram 18 has a threaded shank 26 for engaging the threaded bore 24 of the chuck 16. Likewise, the sleeve 20 carries external threads 28 for engaging the threaded bore 24 of the chuck 16.

Referring now to FIGS. 1 and 4, the sleeve 20 has a cylindrical bore 30 and a conical counterbore 32. The diameter of the bore 30 slightly exceeds the external thread diameter of the threaded shank-drill portion 34 of the self-drilling sheet metal screw 14. The self-drilling sheet metal screw 14 includes a conical head 36. According to this arrangement, the threaded shank 34 of the self-drilling sheet metal screw 14 slides through the sleeve 20 and the cylindrical bore 30 without binding engagement. The conical head 36 of the self-drilling sheet metal screw engages the beveled sidewall of the counterbore 32 as illustrated in FIG. 4.

In the assembled view shown in FIG. 4, the chuck 16 is provided with an anchor portion 38 on which the back plate 22 is mounted for rotation. The edge of the anchor portion 38 is rolled outwardly after the back plate has been slipped onto the anchor portion 38, thereby forming an axial retaining shoulder with an outer chuck surface 40 for the back plate 22. The annular back plate 22 has a large diameter circular opening 42 which is slightly larger than the anchor portion diameter 38, thereby allowing the back plate 22 to slip freely without binding as the anchor portion 38 rotates.

The axial projection of the rolled edge 40 of the anchor portion 38 is exaggerated somewhat as illustrated in FIG. 4. In the preferred embodiment of this construction, the outer chuck surface 40 should lie flush with a face 20A of the sleeve 20 sufficiently to confine the back plate onto the anchor portion 38 with a spacing noted at 39 which has a minimum depth of 0.020 inch. Preferably, the exterior face of the back plate 22 is counterbored and the edge of the retaining shoulder is rolled over into the counterbore as can best be seen in FIG. 4. According to this arrangement, a portion of the dented sheet metal 48 will be drawn against the face 20A of the sleeve 20, and other portions of the sheet metal panel will be engaged by the back plate 22 so as to leave a circular indentation 41 slightly larger than the diameter of the face 20A of the sleeve 20 plus the outer chuck surface 40 of the anchor portion 38 for reasons to be explained.

In the next step of the assembly of the sheet metal repair rotary tool assembly 10, the sleeve 20 is threaded into the bore 24 of the chuck 16 until it is flush with the chuck surface 40 of the anchor portion 38. Next, the self-drilling sheet metal screw or threaded drill bit 14 is dropped into the bore 30 of the sleeve 20. Because of the relatively large diameter of the sleeve bore 30, the self-drilling sheet metal screw 14 drops through the bore until its conical head 36 rests in engagement with the beveled counterbore 32. The uppermost portion of the conical head 36 extends out of the conical counterbore 32 by approximately one-sixty-fourth (1/64) to one-thirty-second (1/32) of an inch.

The conical head 36 is driven into compressive engagement with the beveled sidewall of the counterbore 32 by the ram 18. The ram 18 is turned through the threaded bore 24 until the head 18A of the ram engages the conical head 36. As the ram 18 is torqued against the conical head 36, the conical head 36 is locked against the beveled counterbore 32. The interlocking engagement of the ram threads 26 with the chuck threads 24 firmly secures the ram, sleeve, self-drilling sheet metal screw and chuck together for concurrent rotation without slipping. However, the annular back plate 22, as previously discussed, is appropriately sized whereby it will slip freely on the anchor portion 38 as the chuck assembly rotates.

The cylindrical ram 18 is provided with an elongated coupling shaft 44. The coupling shaft 44 is appropriately sized for engagement by the chuck 46 of the power drill 12 (FIG. 5). The coupling shaft 44 may have either a square or circular cross section. A square cross-section is preferred so that it can be manipulated by a wrench for torquing the ram 18 against the conical screw head 36. The chuck 16 is preferably provided in a hex configuration so that it can be conveniently engaged by a box wrench for reacting the torque forces during the ram 18 tightening operation.

A second embodiment of the rotary tool assembly 50 is shown in FIG. 6 having the following identical, previously described elements being: (1) the ram 18; (2) power drill 12; and (3) the self-drilling sheet metal screw 14. The changes in this embodiment are in (1) a combination of the chuck 16 and the sleeve 20 being a chuck assembly 16A; and (2) the prior annular back plate 22 is a back plate 22A.

The chuck assembly 16A is of a one piece construction having a threaded bore 24A to receive the ram 18 therein and a central cylindrical bore 30 with a conical counterbore 32 therein. The self-drilling sheet metal screw 14 is adapted to fit within the bore 30 and the counterbore 32 as previously described.

The ram 18 is adapted to be threaded within the threaded bore 24A against a top portion of the self-drilling sheet metal screw 14 as previously described.

The back plate 22A includes a back plate 22 and a support plate 52. The back plate 22 is as previously described having a central circular opening 42 and an outer surface 54 which contacts the dented sheet metal being worked upon.

The support plate 52 is rotatably mounted in the anchor portion 38 on the chuck assembly 16A.

The support plate 52 is secured as by welding or the like to the back plate 22A for conjoint rotation therewith.

The spacing of the back plate 22A relative to an outer surface of the chuck assembly 16A is always greater than 0.020 inch as indicated at 58 in order to form one of the circular indentations 41 in a damaged sheet metal for reasons to be explained.

The back plates 22 and 22A can be of various sizes and shapes such as square, rectangular, oblong, etc., so as to be most efficient on many types of damaged areas in sheet metal.

Referring now to FIG. 5, the side sheet metal panel 46 of the truck has a dented area 48. The self-drilling sheet metal screw or threaded drill bit 14 is applied at a selected point 50 within the dented area 48. When the power drill 12 is energized, rotation of the tool body causes the self-drilling sheet metal screw or threaded drill bit 14 initially at its out end drill bit section to penetrate the sheet metal 48 and produce a hole 49. After the self-drilling sheet metal screw 14 has entered the sheet metal, back pressure is applied manually through the power drill 12 and the sheet metal is pulled outwardly as the screw threads 34 rotate due to reaction forces between the contact of the back plate 22 or 22A with the sheet metal panel 46. Drilling is continued until the sheet metal panel 48 is pulled against the rotary back plate 22 and a circular indentation 41 is formed on the sheet metal panel 46 greater than the diameter of the face 20A and the chuck surface 40 of the anchor portion is formed about the drilled hole 49. This circular indentation about the drilled hole 49 has an inclined sidewall 51 and is important to give depth to this area when finished by filling the area with a repair compound then grinding and sanding. Without the circular indentation 41, the area of the drilled hole 49 would be very thin and the filler material would have a tendency to fall out inwardly which is known in the prior art as ring out or shrink back.

As the sheet metal panel 46 of the dented area 48 is pulled flat against the back plate 22 or 22A, the metal surrounding the self-drilling sheet metal screw 14 becomes stripped, thereby releasing the rotary tool assembly 10. This process is repeated until the dented area 48 of the sheet metal panel 46 approximates its original form. The drill holes openings 49, the circular indentations 41, and the restoration area are then filled as necessary, and the dented region is then finished by grinding, sanding, priming and painting. This repaired area forms a head or rivet 62 of repair material plus the repair material in the circular indentation 41 for a secured repair element to prevent ring out or shrink back.

According to the foregoing procedure, the dented panel region is automatically pulled flat at a selected point whereby the original curvature or contour of the sheet metal panel can be approximated. Accordingly, only a minimum amount of filler is required and the finishing time required for grinding and sanding is also minimized.

The self-drilling sheet metal screw or threaded drill bit 14 can be changed as frequently as desired to replace worn threads, worn drill bit portion, or to provide a self-drilling sheet metal screw or threaded drill bit having a different length or diameter, merely by withdrawing the ram 18 from the threaded bore 24 of the chuck 16.

The method of this invention as shown in FIGS. 7, 8, and 9 involves the steps of (1) applying an outer end of the rotating self-drilling sheet metal screw 14 against a dented area of a sheet metal panel 48 to penetrate same and produce a hole 49; (2) contacting the threaded portion 34 with the sheet metal panel 48 and pull same toward the anchor portion 38; (3) contacting the back plates 22 or 22A with the damaged area of the sheet metal panel 48 to pull same toward and into contact with an outer surface of the anchor portion 38; (4) further rotating the self-drilling sheet metal screw 14 to strip the threaded portion from the sheet metal panel 48 and form a circular indentation 41 about the drilled hole 49 greater than the diameter of the anchor portion 38; (5) filling the drilled holes 49 and the circular indentations 41 with a repair material, such as epoxy to form a double headed rivet structure on both sides of the respective holes 49; and (6) sanding the exterior side of the area of the filled holes 49 to form a repaired rivet member 64. As shown in FIGS. 10 and 11, the repaired rivet member 64 has a considerable amount of the repair material on both sides of the drilled holes 49 to prevent ring out or shrink back which is a considerable problem with prior art repair methods.

Although the invention has been described with reference to a preferred embodiment, it will be appreciated by those skilled in the art that additions, deletions, modification, substitutions and other changes not specifically described in this embodiment may be carried out to achieve the objects of the invention and fall within the scope and spirit of the appended claims.

I claim:

1. A rotary tool assembly operable to repair a dented area in a sheet metal panel, comprising:

(a) a chuck assembly adapted to be rotated about a longitudinal axis and having means connected thereto for attachment to rotary drive means;

(b) said chuck assembly having a central bore and an outer anchor portion with an outer chuck surface at one end thereof extending transversely to said longitudinal axis;

(c) a self-drilling sheet metal screw mounted within said bore and having a portion extended outwardly of said outer chuck surface of said chuck assembly;

(d) said chuck assembly having a back plate mounted to said anchor portion by means to permit limited axial movement and relative rotation with respect to said anchor portion, said back plate positioned inwardly of said outer chuck surface whereby said outer chuck surface engages the sheet metal panel about said self-drilling sheet metal screw and said back plate engages the sheet metal panel laterally of said outer chuck surface; and (e) said outer chuck surface rotates with said self-drilling sheet metal screw to pull the sheet metal panel against said outer chuck surface to form an indentation and automatically strip said self-drilling sheet metal screw from the sheet metal panel.

2. A rotary tool assembly as described in claim 1, wherein:

(a) said back plate having an outer surface spaced a minimum of 0.020 inch from said outer chuck surface whereby said indentation will have a depth of at least 0.020 of an inch.

3. A rotary tool assembly as described in claim 1, wherein:

(a) said self-drilling sheet metal screw having a threaded shank portion integral with an outer drill bit portion:

(b) said drill bit portion to penetrate and produce a drilled hole in the sheet metal panel; and (c) said threaded shank portion adapted to pull the sheet metal panel against said outer chuck surface to form said indentation and then to cut and strip the sheet metal panel from said self-drilling sheet metal screw whereby said outer chuck surface engages the sheet metal panel about the drilled area to produce a flat indentation without any projections about the drilled hole toward said outer chuck surface.

4. A method of repairing a dented area in a sheet material with a rotary tool having a chuck assembly with an outer anchor portion and an outer chuck surface; a self-drilling sheet metal screw mounted in said chuck assembly for rotation therewith and extended outwardly of said outer chuck surface; a back plate received in an annular groove in said outer anchor portion of said chuck assembly for relative rotation and limited axial movement with respect to said outer anchor portion and extended laterally from said chuck assembly, said back plate mounted inwardly of the outer chuck surface; the steps comprising:

(a) rotating said chuck assembly with an outer end of said self-drilling sheet metal screw against a portion of the dented area;

(b) producing a hole in the dented area by said self-drilling sheet metal screw and threading said hole:

(c) threadably pulling the sheet material about the rotating said self-drilling sheet metal screw toward said chuck assembly and against said back plate to form an indentation in the sheet material by said outer chuck surface;

(d) stripping the rotating said self-drilling sheet metal screw from the hole;

(e) filling the indentation and the area in the hole on both sides thereof with a filler material; and (f) sanding an outer surface of the filler material to leave a rivet through the hole.

5. A method of repairing as described in claim 4, wherein:

(a) said indentation having a minimum depth of 0.020 inch.

6. A method of repairing as described in claim 5, wherein:

(a) said filling of the area in said hole producing a rivet of filler material therein having a minumum thickness of 0.020 inch on an outer side and a rivet head on the inner side to secure same to said sheet material.

7. A rotary tool assembly for repairing a dent in sheet metal, comprising:

(a) a chuck having an anchor portion formed on one outer end thereof and a central bore;

(b) said anchor portion having an annular groove on its external surface;

(c) a back plate having an opening therein;

(d) said outer end of said chuck extending through said opening to receive said backing plate within said annular groove;

(e) said annular groove dimensioned to allow limited axial movement of said back plate therein and relative rotation between said back plate and said chuck;

(f) a self-drilling sheet metal screw mounted in said central bore of said chuck having an outer drill bit portion projected outwardly from said outer end of said chuck and said back plate whereby said drill bit portion penetrates the sheet metal, said back plate engages and held against rotation by the sheet metal, said self-drilling sheet metal screw pulls the sheet metal against the rotating said outer end of said chuck to form an indentation in the sheet metal with the sheet metal laterally of said indentation pulled against said back plate; and (g) means connected to said chuck for attachment to a rotary drive.

8. A sheet metal repair rotary tool assembly for repairing a dent in a sheet metal material, comprising:

(a) a chuck assembly adapted to be rotated about its longitudinal axis and having an anchor portion on an outer end thereof;

(b) a self-drilling sheet metal screw seized by said chuck assembly having a threaded shank portion integral with an outer drill bit portion, both projecting outwardly from said outer end of said chuck assembly;

(c) a back plate having an opening receiving said anchor portion of said chuck assembly therein;

(d) said opening and said anchor portion are arranged to allow limited axial movement and relative rotation between said chuck assembly and said back plate;

(e) said back plate positioned inwardly of an outer chuck surface of said outer end of said chuck assembly, said outer chuck surface extending transversely to said longitudinal axis;

(f) said self-drilling sheet metal screw rotates with said chuck assembly to form a hole with said outer drill bit portion in the sheet metal material and pull same against said back plate with said threaded shank portion;

(g) said outer chuck surface of said chuck assembly forms an indentation in the sheet metal material prior to stripping said self-drilling sheet metal screw from the sheet metal material; and (h) means connected to said chuck assembly for attachment to a rotary drive means.

* * * * *